US005209982A

United States Patent [19]

Defrenne

[11] Patent Number: 5,209,982

[45] Date of Patent: May 11, 1993

[54] METHOD OF MANUFACTURING PAPER FOR BOTTLE LABELS

[75] Inventor: Daniel Defrenne, Loupoigne, Belgium

[73] Assignee: Intermills Industrie Pont-de-Warche S.A., Malmedy, Belgium

[21] Appl. No.: 474,840

[22] PCT Filed: Jan. 18, 1989

[86] PCT No.: PCT/BE89/00005

§ 371 Date: Oct. 22, 1990

§ 102(e) Date: Oct. 22, 1990

[87] PCT Pub. No.: WO90/08223

PCT Pub. Date: Jul. 26, 1990

[51] Int. Cl.[5] ..... B32B 23/08; B32B 27/10

[52] U.S. Cl. ..... 428/511; 427/208; 427/209; 427/377; 427/382; 427/391; 428/514

[58] Field of Search ..... 162/136, DIG. 6; 427/362, 391, 208, 209, 377, 382; 428/511, 514

[56] References Cited

U.S. PATENT DOCUMENTS

| | | | |
|---|---|---|---|
| 3,578,493 | 5/1971 | Smith | 427/391 X |
| 3,853,594 | 12/1974 | Moroff et al. | 427/391 X |
| 4,112,192 | 9/1978 | Vreeland | 427/391 X |
| 4,317,849 | 3/1982 | Ogura et al. | 427/362 |
| 4,370,389 | 1/1983 | Ogura et al. | 162/136 X |
| 4,515,833 | 5/1985 | Nojima et al. | 427/362 |
| 4,900,583 | 2/1990 | Hirabayashi et al. | 427/362 X |

FOREIGN PATENT DOCUMENTS

| | | |
|---|---|---|
| 0015517 | 9/1980 | European Pat. Off. . |
| 1569879 | 4/1970 | Fed. Rep. of Germany . |
| 3328064 | 2/1984 | Fed. Rep. of Germany . |

*Primary Examiner*—Michael Lusignan
*Attorney, Agent, or Firm*—Charles F. Meroni, Jr.

[57] ABSTRACT

Coated paper for labels, specially adapted to the conditions of utilization in breweries, is fabricated by applying to one side of the fibrous label paper medium a hydrophilic coating slip having a fast reaction to water so as to accelerate the absorption of water and by applying to the other surface a coating of a composition containing a binder comprising a mixture of cross-linkable and soft latex. Strict electronic control of the moisture rate of the paper during the manufacturing process provides for a remarkable dimensional stability and an excellent inherent flatness in a relatively large moisture range.

18 Claims, 2 Drawing Sheets

METHOD OF MANUFACTURING PAPER FOR BOTTLE LABELS

PRIOR ART

The present invention relates to the manufacture of coated paper, and concerns in particular improvements aimed at enhancing the properties of the coated paper intended for producing bottle labels.

Labels for bottles used to contain drinks have to meet a certain number of criteria, which can be summarised briefly as follows:

1. The label media have to prove perfect labelling, ie have perfect adhesion to the bottles. Suitability for labelling is is defined by the loss of stiffness of the paper in the moist state, which is related to the speed of absorption of the water.

2. The label media have to be dimensionally stable over a large range of relative humidity so as to remain perfectly flat during the operations to which they are subjected.

3. The printing inks and surface lacquers have to develop the maximum amount of brightness: the penetration of the inks and lacquer into the medium has to be as low as possible.

4. The labels have to be non-flaking.

In addition, in order to protect the natural environment, the label medium has to be made as non-polluting as possible and, to this end, the labels have to have high resistance to chemical agents (caustic soda) in order not to pollute the washing baths, and they have to contain a proportion of free formaldehyde which is as low as possible, since free formaldehyde upsets the persons handling the labels and it deposits on the bottles traces which destroy the yeasts in the drinks.

Paper for labels consists of a fibrous medium, the front face of which carries a coating of material provided to permit printing, and the reverse face of which is covered with a coating slip designed to provide the labelling qualities. According the prior art, the labelling qualities are obtained by using, to cover the reverse face, a coating slip which is relatively impervious to water. The quantity of water absorbed by the paper is then usually of the order of 12 to 15 grams per square meter.

The performance of papers for labels produced according to the prior art can be summarised as follows:

| | |
|---|---|
| Suitability for labelling<br>Loss of stiffness in the moist state | 45% to 50% |
| Flatness range<br>Maintaining flatness from 45% to 80% relative humidity. | |
| Adhesion of inks and lacquers<br>Loss of material after soaking in a caustic soda solution | 12 to 15 g/m$^2$ |
| Concentration of formaldehyde released during handling | 35 to 60 mg/m$^2$ |

It transpires that the characteristics of the papers currently on the market for producing labels are hardly ever entirely suitable for the severe conditions of use in the brewing and soft drinks industries.

SUMMARY OF THE INVENTION

The invention relates to a method of manufacturing coated paper which improves remarkably the performance and labelling qualities of the coated paper for labels.

The invention also relates to a technique for manufacturing coated paper which reduces pollution in the washing baths very markedly, following in line with changes in the European standards in this regard.

Finally, the invention relates to a new generation of coated label paper which meets the requirements of breweries.

More particularly, the invention relates to improvements in the manufacture of coated paper, which lie essentially in three directions:

1) the composition of the coating slip applied to the reverse face of the paper so as to improve its suitability for labelling, 2) the composition of the coating applied to the front face of the paper so as to improve the adhesion of the inks and reduce pollution in the washing baths, 3) the process of manufacturing the paper so as to confer on the labels the desired dimensional stability.

The details of the techniques according to the invention are set out in the claims.

DESCRIPTION OF AN EXEMPLARY EMBODIMENT

The fibrous pulps which are to serve as a base for the paper are mixed in a mixing chest, in which are also added the usual fillers (kaolin, talc, titanium) and any sizing and wet strength agents required. The fibrous composition is for example:

| | |
|---|---|
| Base - long bleached fibres | 55.00% |
| - short bleached fibres | 37.00% |
| Titanium dioxide | 0.90% |
| Talc | 0.90% |
| Kaolin | 0.90% |
| Optical brightener | 0.02% |
| Sizing agents | sufficient quantity |
| Example of acidic sizing: | |
| Sodium aluminate | 0.09% |
| Sulphate of alumina | 2.50% |
| Urea formaldehyde | 0.25% |
| Melamine formaldehyde | 0.25% |

The additives can also be added to the mixture continuously whilst observing the recommended minimum contact times upstream of the machine stuff chest.

Figure 1:
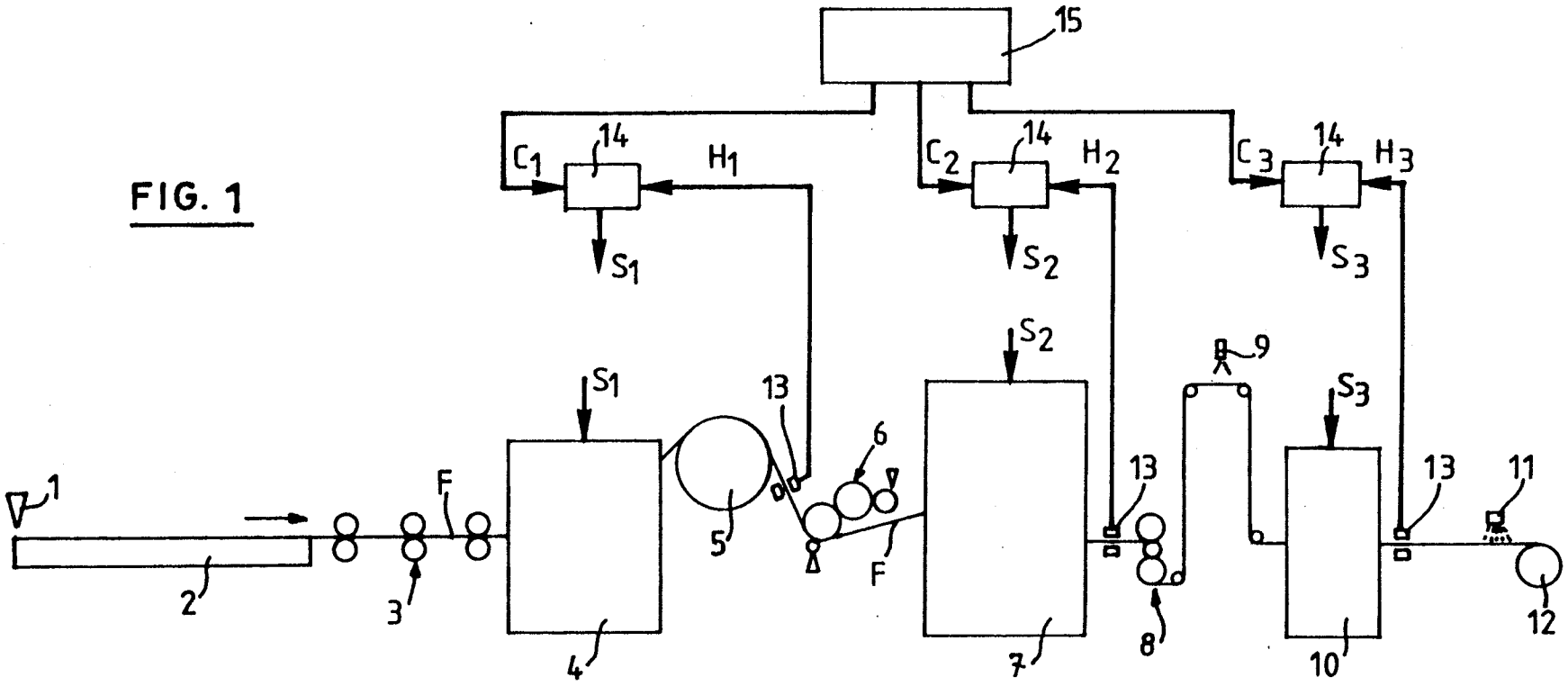
FIG. 1 is a simplified general diagram of an example of a papermaking machine utilising the method of the invention.

After refining of the mixture in order to promote interfibre bonding, the pulp is poured into the stuff chest 1. Referring to FIG. 1, the stuff chest is shown as 1. The pulp then passes onto a dewatering bed 2 to eliminate the water from it and under press rollers 3, and then the base F passes into a first dryer 4. The base then contains 0.5 to 8% water.

The dryer is a known device which can be constructed in various embodiments.

At the discharge from the dryer 4, the base passes under a friction roller 5, which finishes preparing the base for the coating of the front and reverse faces. The base then passes into a coating unit 6 in which the front and reverse faces are coated by means of coating slips. The coating device can be any kind of known device (a blade, rotating scraper and/or roller device for example). The coating unit is advantageously arranged to coat the front and reverse faces simultaneously. Optionally the coating can be carried out successively on each of the faces with intermediate drying.

The composition of the coating slips is selected carefully according to the invention, in order to optimise the performance of the paper. According to a first aspect of the invention, the composition of the coating slip applied to the reverse face is selected to improve the suitability for labelling. This improvement is achieved by accelerating the reaction of the coating slip to water, so as to produce rapid absorption of water. The quality of a labelling is in fact related to the loss of stiffness of the base in its moist state, which represents the speed of absorption of water by the coating slip on the reverse face. Whilst the coating slip on the reverse according to the prior art is generally made less water absorbent, the composition of the coating on the reverse according to the invention is produced so that the coating is hydrophilic. This result is obtained by choosing for the binder which normally forms part of the composition of the coating slip for the reverse face, a mixture of starch and latex containing a very active absorbing agent, for example a type DL 636 latex made by Dow Chemical. A specimen composition for the coating slip for the reverse face according to the invention is given below:

| | |
|---|---|
| English kaolin | 80.0% |
| Starch | 9.5% |
| Dow Chemical latex type DL 636 | 9.5% |
| Urea formaldehyde | 0.5% |
| Melamine formaldehyde | 0.5% |

Figure 2:
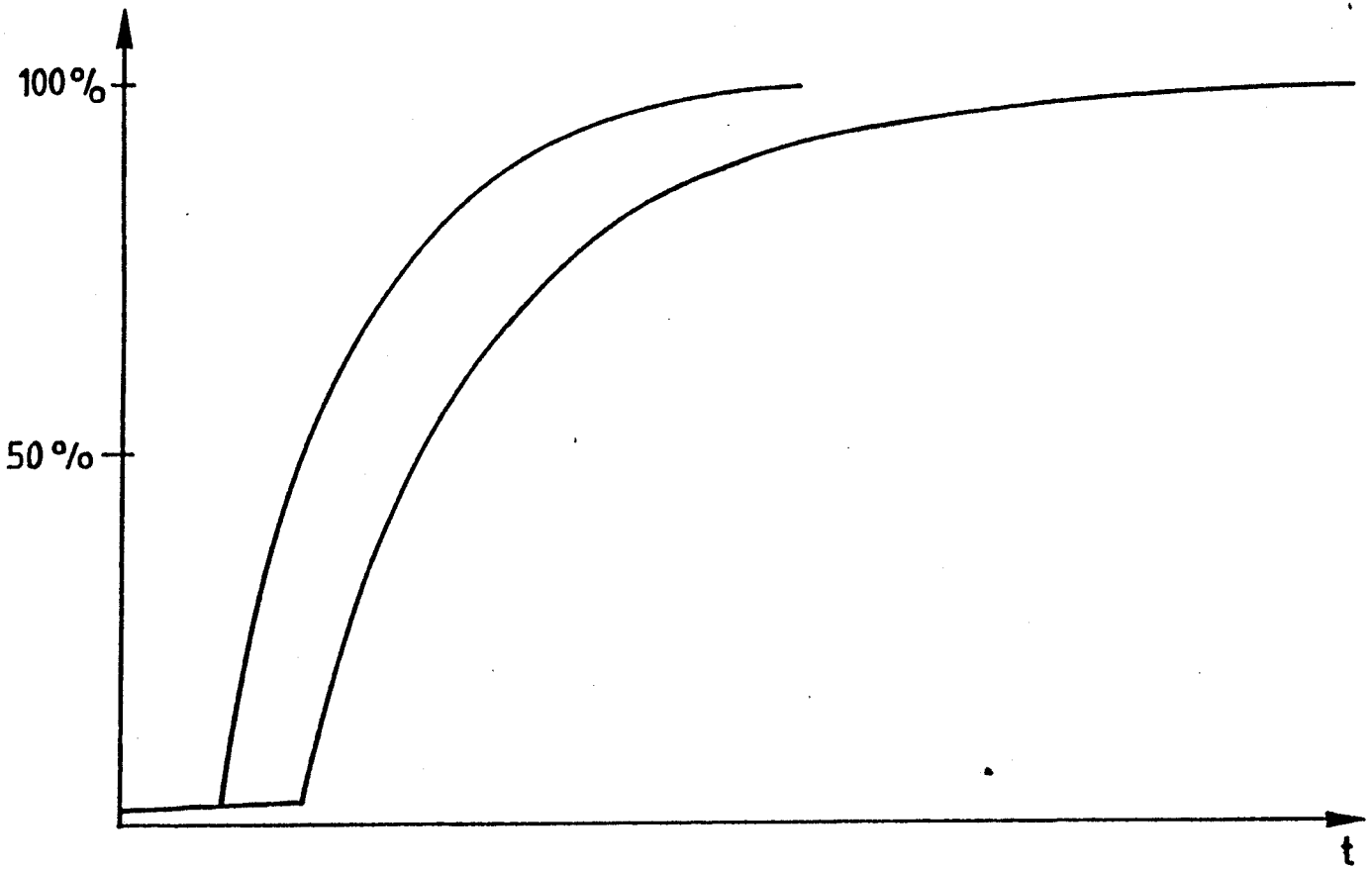
FIG. 2 is a diagram showing a typical water absorption curve for a paper produced in accordance with the invention and, by way of comparison, a typical water absorption curve for a paper according to the prior art.

The diagram in FIG. 2 shows the curve for the speed of water absorption of a paper according to the invention (curve A) compared with a curve for the typical speed of water absorption of a paper according to the prior art (curve B). The X axis contains the time scale, and the rate of water penetration from the reverse face of the paper towards the front face is set out along the Y axis. Curve A shows that the absorption of water by the paper produced according to the invention is greatly accelerated. This rapid reaction to water, almost immediate, not only provides excellent adhesion of the label to a bottle, but also prevents the edges of the label affixed to the bottle from coming unstuck at the edges.

A second aspect of the invention relates to the composition of the coating for the front face, which is selected to increase the adhesion of the inks and lacquers compared with the prior art, whilst reducing pollution of the washing baths during the recycling of the bottles bearing the labels. In order to achieve this result, the invention chooses for the binder a combination of cross-linkable latex and soft latex with the addition of an agent for reducing solubility, which fixes all the free links in the cross-linkable latex. For the pigment material a mixture of kaolin and calcium carbonate with very fine particles is chosen. A specimen composition for the front face coating is given below:

| | |
|---|---|
| Kaolin | 57% |
| Calcium carbonate | 24% |
| Rohm & Haas type E581 hard latex | 7% |

-continued

| | |
|---|---|
| Dow Chemical type DL 570 soft latex | 10% |
| Agent for reducing solubility | 2% |

The calcium carbonate has a particle size distribution of 98% of particles less than 2 microns and 80% of particles less than 1 micron.

After the operation of coating the reverse and front faces, the paper passes into a second dryer 7 in order to dry the coated reverse and front faces, then between glazing rollers 8, before being taken to a rewetting unit 9 formed by a sprinkler pipe. The rewetted paper then passes into another dryer 10. At the discharge from the latter, the paper passes again beneath a second rewetting pipe 11, before being wound on a reel-up 12.

In accordance with another aspect of the invention, the paper is subjected to successive controlled drying-rewetting cycles which have the effect of giving the paper a remarkable dimensional stability independently of the wetness, and thus of guaranteeing to the labels an exceptional flatness. In order to carry out the drying-rewetting cycles, the invention provides for a rigorous control of the moisture content of the paper as soon as the felt is ready for coating. Referring to FIG. 1, three devices referenced 13 are shown: the first upstream of the coating unit 6, the second downstream of the dryer 7 and the third downstream of the dryer 10. These devices are devices for measuring the moisture content which can be of any known type, for example a moisture content measuring device of the Accuray make. These measuring devices are mounted so as to sweep the surface of the paper and produce a measuring signal representing the moisture content. The measuring signals of the three devices 13 in FIG. 1 are referenced H1, H2 and H3. The number of measuring devices 13 is obviously in no way limited to three.

The measuring signals are received in a control unit in which each measuring signal is compared with a predetermined reference signal: the signal H1 is compared with the reference signal C1, the signal H2 with the reference signal C2 and the signal H3 with the reference signal C3. The reference signals are generated and stored in a control processor 15. The references are chosen according to the characteristics of the paper to be produced. The reference and measuring signals are compared in a comparison device 14 arranged to produce respectively a command signal S1, S2, S3 representing the difference between each measuring signal and the corresponding reference signal. The command signal S1 serves to adjust the heating power of the dryer 4 in order to reduce to zero the difference between the measured humidity represented by the signal H1 and the corresponding reference represented by the signal C1. The signal S2 serves to adjust the heating power of the dryer 7 in order to reduce to zero the difference between the measured humidity represented by the signal H2 and the corresponding reference represented by the signal C2. The signal S3 serves to adjust the heating power of the dryer 10 in order to reduce to zero the difference between the measured humidity represented by the signal H3 and the corresponding reference represented by the signal C3. In one example of implementation for manufacturing a coated label paper having a 50% relative humidity, the absolute humidity is adjusted by the references C1, C2 and C3 to a value of 5.5%.

The method of the invention thus makes it possible to obtain a coated label paper with a performance which is substantially improved compared with that of label papers produced according to prior technology. The performance obtained according to the invention can be summarised as follows:

| | |
|---|---|
| 1. Suitability for labelling<br>Loss of stiffness in the moist state | ≧70% |
| 2. Flatness range<br>Maintenance of flatness | 15 to 90%<br>relative humidity |
| 3. Adhesion of inks and lacquers<br>Loss of material after soaking in a solution of caustic soda | ≦1 g/m$^2$ |
| 4. Amount of formaldehyde given off during handling | ≦20 mg/m$^2$ |

This performance, compared with that of known label papers, shows the remarkable progress brought by the invention into the field of the art. The performance obtained by virtue of the manufacturing technique of the invention is perfectly suited to all the conditions of use in breweries and to the requirements of printers and metal coaters. The invention makes it possible to obtain this remarkable performance with a reverse face covered with a coating slip whose weight can advantageously be reduced to 1.5 g/m$^2$ and even to approximately 0.5 g and with a front coating whose weight can be considerably less than 15 g/m$^2$. It will moreover be emphasised that the great reduction in pollution in the washing baths follows in line with changes in the European standards and that the reduction in the levels of formaldehyde released during handling improves the conditions of work and decreases the risk of contamination of the drinks.

The embodiment of the invention described above is one example given by way of illustration, and the invention is in no way limited to this example. Any modification, variant and equivalent arrangement must be considered to be included within the scope of the invention.

I claim:

1. A method of manufacturing a coated paper suitable for use as a coated label to be applied to a bottle, said label includes a fibrous base and a first coating and a second coating, said method including the steps of:

a. forming said fibrous base, wherein:
   1. said fibrous base has a front face and a reverse face,
   2. said front face is visible when said label is applied to said bottle;
   3. said reverse face is in direct contact with said bottle when said label is applied to said bottle;

b. applying a hydrophilic coating slip to said reverse face of said fibrous base, said hydrophilic coating slip having a rapid reaction with water to accelerate a reaction therewith as a first step in forming said coated label;

c. applying a coating mixture to said front face of said fibrous base, said mixture comprising a cross-linkable latex and a soft latex as a second step in forming said coated label;

d. subjecting sad coated label to at least one controlled drying-rewetting cycle to adjust a moisture content of said label to a predetermined set of characteristics; and e. recovering said label.

2. Method according to claim 1, characterized in that the coating slip applied to the reverse face of the fibrous base is made of a latex containing an active absorption agent.

3. Method according to claim 2, characterized in that the composition of the hydrophilic coating slip is chosen to have a high speed of water absorption during a predetermined space of time.

4. Method according to claim 3, characterized in that to the mixture of cross-linkable latex and soft latex is added an agent for reducing solubility, fixing all the free links in the cross-linkable latex.

5. Method according to claim 4, characterized in that a mixture of kaolin and calcium carbonate or an equivalent compound, with very fine particles is added to the front face coating.

6. Method according to claim 5, characterized in that the calcium carbonate or equivalent compound is added with particle sizes whose distribution is approximately 98% particles less than approximately 2 microns ad approximately 80% particles less than 1 micron.

7. Method according to claim 1, characterized in that each electronically controlled drying-rewetting cycle includes the steps of measuring the moisture content of the paper after a drying stage and producing a signal representing the moisture content, and comparing the produced signal with a predetermined stored reference value in an electronic controller so as to produce a command signal proportional to the difference between the produced signal and the corresponding reference value, said command signal automatically adjusting the heating power used in the aforesaid drying state.

8. Method according to claim 1 characterized in that each electronically controlled drying-rewetting cycle includes the steps of measuring the moisture content of the paper after a drying stage and producing a signal representing the moisture content, and comparing the measuring signal with a predetermined stored reference value in an electronic controller so as to produce a command signal (S1, S2, S3) proportional to the difference between the produced signal and the corresponding reference value, said command signal automatically adjusting the heating power used in the aforesaid drying state.

9. Coated label paper intended to be used on bottles, manufactured according to the method of claim 1.

10. The method of manufacturing a coated paper as set forth in claim 1 wherein said at least one controlled drying-rewetting cycle is an electronically controlled drying-rewetting cycle.

11. A method of manufacturing a coated paper suitable for use as a coated label to be applied to a bottle, said label including a fibrous base and a first coating and a second coating, said method including the steps of:

a. forming said fibrous base, wherein
   1. said fibrous base has a front face and a reverse face,
   2. said front face is visible when said when said label is applied to said bottle;
   3. said reverse face is in direct contact with said bottle when said label is applied to said bottle;

b. applying a coating mixture to said front face of said fibrous base, said mixture comprising a cross-linkable latex and a soft latex as a first step in forming said coated label;

c. applying a hydrophilic coating slip to said reverse face of said fibrous base, said hydrophilic coating slip having a rapid reaction with water to accelerate a reaction therewith as a second step in forming said coated label;

d. subjecting said coated label to at least one controlled drying-rewetting cycle to adjust a moisture content of said label to a predetermined set of characteristics; and e. recovering said label.

12. The method of manufacturing a coated paper as set forth in claim 11 wherein said at least one controlled drying-rewetting cycle is an electronically controlled drying-rewetting cycle.

13. The method of manufacturing a coated paper as set forth in claim 12, characterized in that the coating slip applied to the reverse face of the fibrous base is made of a latex containing an active absorption agent.

14. The method of manufacturing a coated paper as set forth in claim 13, characterized in that the composition of the hydrophilic coating slip is chosen to have a high speed of water absorption during a predetermined space of time.

15. The method of manufacturing a coated paper as set forth in claim 14, characterized in that to the mixture of cross-linkable latex and soft latex is added an agent for reducing solubility, fixing all the free links in the cross-linkable latex.

16. The method of manufacturing a coated paper as set forth in claim 15, characterized in that a mixture of kaolin and calcium carbonate or an equivalent compound, with very fine particles is added to the front face coating.

17. The method of manufacturing a coated paper as set forth in claim 16, characterized in that the calcium carbonate or equivalent compound is added with particle sizes whose distribution is approximately 98% particles less than approximately 2 microns and approximately 80% particles less than 1 micron.

18. The method of manufacturing a coated paper as set forth in claim 17, characterized in that each electronically controlled drying-rewetting cycle includes the steps of measuring the moisture content of the paper after drying stage and producing a signal representing the moisture content, and comparing the produced signal with a predetermined stored reference value in an electronic controller so as to produce a command signal proportional to the difference between the produced signal and the corresponding reference value, said command signal automatically adjusting the heating power used in the aforesaid drying stage.

* * * * *